US005468553A

United States Patent [19]

Koike et al.

[11] Patent Number: 5,468,553

[45] Date of Patent: Nov. 21, 1995

[54] CLOTH SUITABLE FOR TEXTILE PRINTING AND INK-JET TEXTILE PRINTING METHOD

[75] Inventors: Shoji Koike; Tomoya Yamamoto, both of Yokohama, Japan

[73] Assignee: Canon Kabushiki Kaisha, Tokyo, Japan

[21] Appl. No.: 8,330

[22] Filed: Jan. 25, 1993

[30] Foreign Application Priority Data

Jan. 27, 1992 [JP] Japan ..... 4-034063

[51] Int. Cl.[6] ..... D03D 3/00

[52] U.S. Cl. ..... 428/224; 428/227; 428/245; 428/913; 347/103; 347/105

[58] Field of Search ..... 428/913, 224, 428/195, 227, 245; 427/150, 261; 8/495, 602; 347/103, 105

[56] References Cited

U.S. PATENT DOCUMENTS

| | | | |
|---|---|---|---|
| 4,702,742 | 10/1987 | Iwata et al. | 8/495 |
| 4,725,849 | 2/1988 | Koike et al. | 346/1.1 |
| 4,786,288 | 11/1988 | Handa et al. | 427/150 |
| 4,849,770 | 7/1989 | Koike et al. | 346/1.1 |
| 4,969,951 | 11/1990 | Koike et al. | 106/22 |
| 5,067,980 | 11/1991 | Koike et al. | 106/22 |
| 5,075,699 | 12/1991 | Koike et al. | 346/1.1 |

FOREIGN PATENT DOCUMENTS

| | | |
|---|---|---|
| 54-59936 | 5/1979 | Japan . |
| 62-53492 | 3/1987 | Japan . |

*Primary Examiner*—Patrick J. Ryan
*Assistant Examiner*—William A. Krynski
*Attorney, Agent, or Firm*—Fitzpatrick, Cella, Harper & Scinto

[57] ABSTRACT

A cloth suitable for textile printing, mainly composed of silk fibers, is formed of silk threads which have an average thickness of 14 to 147*d* and which are composed of silk fibers having an average thickness of 2.5 to 3.5*d*, the cloth having a moisture percentage of 17 to 112%. In an ink-jet textile-printing method, a textile printing ink is imparted to the cloth, and then a dyeing process is conducted, followed by a washing process.

9 Claims, 2 Drawing Sheets

CLOTH SUITABLE FOR TEXTILE PRINTING AND INK-JET TEXTILE PRINTING METHOD

BACKGROUND OF THE INVENTION

1. Field of the Invention

This invention relates to a cloth suitable for textile printing and an ink-jet textile printing method. In particular, the cloth of this invention is suitable for ink-jet textile printing which is mainly composed of silk fibers and which exhibits a high degree of exhaustion and high coloring property when used in the formation of a printed image by ink-jet textile printing, making it possible to obtain a clear and fine pattern. This invention also relates to an ink-jet textile printing method using such a cloth.

2. Description of the Related Art

At present, screen textile printing and roller textile printing are the most common methods of textile printing. One problem with these methods is that they require preparation of a plate, so that they are not suitable for the production of a variety of articles in small quantities. Further, it is hard to quickly adapt these methods to the fashions of the day. In view of this, an electronic textile-printing system that does not require plate making is presently desired. To meet this requirement, a number of textile-printing methods based on ink-jet recording have been proposed, and much is expected of these methods from all quarters.

The following are examples of the characteristics required of a cloth used in ink-jet textile printing:

(1) Ability to allow the ink to color in sufficient density.

(2) High degree of exhaustion for the ink.

(3) Ability to allow the ink to dry quickly thereon.

(4) Little generation of irregular ink blurring thereon.

(5) Ease with which the cloth is fed within the printing apparatus.

These requirements have conventionally been satisfied by performing pre-processes on the cloth before printing.

For example, Japanese Patent Laid-Open No. 62-53492 discloses a kind of cloth having an ink-reception layer.

However, although these pre-processes have proved partly effective with respect to the above requirements, the quality of the printed image after the final process depends after all on the basic characteristics of the cloth material used. Thus, a satisfactory material cannot be obtained by such pre-processes. In particular, in the case of a cloth suitable for textile printing mainly composed of silk fibers, the basic material has a considerable influence.

Thus, although the prior-art techniques could find means capable of satisfying the above requirements to some extent, no cloth suitable for textile printing or ink-jet textile printing method has been known up to the present which satisfies all the above requirements at the same time and solves the above-mentioned problems, thereby providing an image of the highest quality.

SUMMARY OF THE INVENTION

It is accordingly an object of this invention to provide a cloth suitable for textile printing and an ink-jet textile-printing method which satisfy all the above-mentioned general requirements of conventional cloths for ink-jet textile printing; that is, the requirements in dyeing technique to obtain an article dyed clearly with no ink blurring and in high density, the requirements in cost to provide a high degree of exhaustion for the ink, and the requirements in operation to provide a high fixation property for the ink and ease with which it can be fed within the printing apparatus, for example.

In accordance with this invention, the above object is achieved by a cloth suitable for textile printing which is mainly composed of silk fibers, the cloth being formed of silk threads which have an average thickness of 14 to 147d and which are composed of silk fibers having an average thickness of 2.5 to 3.5d, the cloth having a moisture percentage of 17 to 112%. (Hereinafter, the symbol "d" after figures denotes the unit "denier".)

Further, in accordance with this invention, there is provided an ink-jet textile-printing method in which a textile printing ink is imparted to a cloth, wherein the above-mentioned cloth is a cloth suitable for textile printing which is mainly composed of silk fibers, the cloth being formed of silk threads which have an average thickness of 14 to 147d and which are composed of silk fibers having an average thickness of 2.5 to 3.5d, the cloth having a moisture percentage of 17 to 112% and wherein, after imparting ink to the cloth, a dyeing process is conducted, and then a washing process is conducted.

DESCRIPTION OF THE PREFERRED EMBODIMENTS

Figure 1:
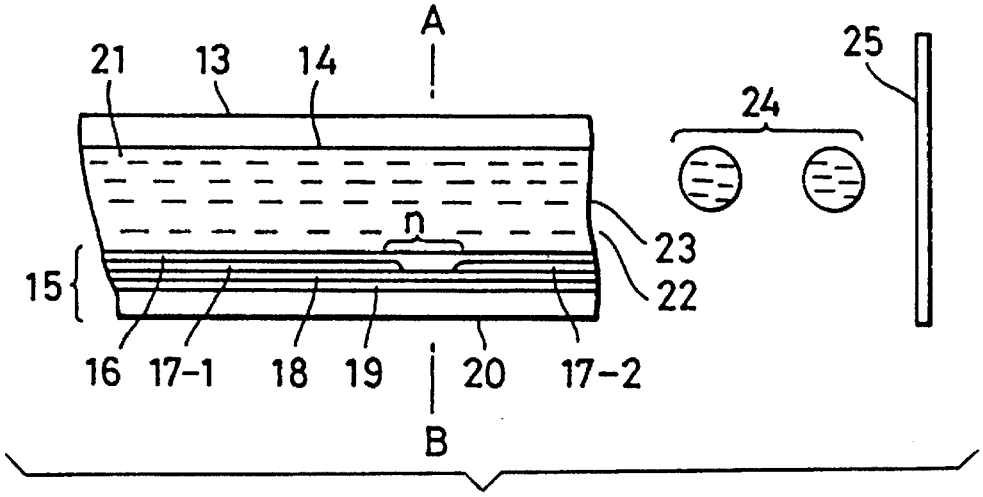
FIG. 1 is a longitudinal sectional view of a head portion of an ink-jet recording apparatus.

An ink-jet textile printing method which uses an ink having a much lower viscosity as compared with conventional printing paste, and forming images by a dot expression of this ink, involves an extremely large number of restrictions with respect to the physical characteristics of the cloth. This is particularly true in the case of a cloth mainly composed of silk fibers.

While attempting to improve a cloth suitable for textile printing mainly composed of silk fibers so that it may satisfy the various requirements mentioned above, the present inventors have found that, apart from the improvements effected, for example, by conducting pre-processes on the cloth as in the prior art, it is possible to remarkably improve the various properties of the cloth, such as coloring property, degree of exhaustion, fixing property, blurring retardation and feeding property, by keeping the moisture percentage of the cloth, which is a basic characteristic of the material, within a fixed range.

This phenomenon appears to be attributable to the fact that impregnation of the cloth with an amount of water larger than the normal amount optimizes the degree of swelling of the fibers, so that even if printing is performed using low-viscosity ink-jet printing inks of various types having a much lower viscosity as compared to the printing pastes conventionally known, the cloth is enabled to display its printing properties to the utmost.

Further, the present inventors have found that it is possible to still further improve the various properties of the cloth, such as coloring property, degree of exhaustion, fixing property, blurring retardation and feeding property, by keeping the average thickness of the silk threads composing the cloth, and the average thickness of the fibers composing the silk threads, within fixed ranges, which thicknesses are basic characteristics of the material, in addition to controlling the moisture percentage of the cloth, thus attaining the present invention.

This phenomenon appears to be attributable to the fact that, in a cloth having a certain construction, the fibers are intertwined in an ideal condition, so that even if printing is performed using low-viscosity ink-jet printing inks of various types having a much lower viscosity as compared to conventionally known printing pastes, the cloth is enabled to display its printing properties to the utmost.

Next, the present invention will be described in more detail with reference to preferred embodiments.

A cloth suitable for textile printing according to a preferred embodiment of the present invention is mainly composed of silk fibers. The cloth has a moisture percentage of 17 to 112% and is formed of silk threads which have an average thickness of 14 to 147d and which are composed of silk fibers having an average thickness of 2.5 to 3.5d.

The cloth of the present invention is mainly composed of silk fibers. The silk is composed of cocoon fibers obtained from the cocoons of silkworms. Raw silk obtained from cocoons is an excellent smooth material which has an elegant silky gloss and which is soft to the touch and supple. Silk fabrics or the like made from this material have various fine properties: they have an appropriate degree of suppleness, are soft to the touch, have an excellent and beautiful gloss, and can be dyed beautiful colors, etc., so that they have been popularly preferred as a clothing material.

Silk fibers consist of a protein called fibroin sericin formed through amino-acid condensation polymerization. Glycine and alanine, which are the amino acids constituting fibroin, form a multitude of peptide linkages to form filamentous high polymers, which in turn accumulate to form monofilaments. A number of these monofilaments are doubled into silk threads having the requisite thickness, which number varies depending on the use.

In this invention, a "cloth suitable for textile printing" implies a woven fabric, a non-woven fabric, a knitted fabric, and a plush fabric which are mainly composed of silk threads. Although it is naturally desirable for the cloth to be made of 100% silk fibers, a blended woven or unwoven fabric or the like, consisting of cellulosic fibers and other materials, can also be used as a cloth suitable for textile printing according to this invention, if the blending ratio is 70% or more or, more preferably, 80% or more of silk fibers.

The moisture percentage, which is a characterizing factor of the cloth suitable for textile printing of this invention, ranges from 17 to 112%, more preferably, from 18 to 92% and most preferably, from 19 to 72%. A moisture percentage of less than 17% results in problems in coloring property and degree of exhaustion. A moisture percentage of more than 112%, on the other hand, results in problems in feeding property and blurring. The official moisture regain of raw silk is 12%.

The measurement of the moisture percentage of the cloth was conducted referring to JIS L 1019. That is, 100 g of a sample was accurately weighed and put in a desiccator at 105±2° C. to be dried until a constant weight was reached. The moisture percentage of the cloth was obtained by the following formula:

$$\text{Moisture percentage}=\{(W-W')/W'\}\times 100$$

(where W: weight before drying; and W': weight after drying)

In the case of a cloth which had undergone a pre-process using a water-soluble high molecular weight polymer or the like, a washing process was conducted after drying the cloth until a constant weight was reached, and then drying was performed again until a constant weight was reached. Then, only the weight of the fiber portion after drying was measured. Then, the moisture percentage of the cloth was obtained by the following formula:

$$\text{Moisture percentage}=\{(W-W')/W''\}\times 100$$

(where W": weight of the fiber portion after washing and drying)

A preferably used cloth suitable for ink-jet textile printing according to this invention has an average thickness of the silk fibers that is kept to 2.5 to 3.5d and, more preferably, 2.7 to 3.3d, and has an average thickness of the silk threads formed of the silk fibers that is kept to 14 to 147d, more preferably, 14 to 126d and, most preferably, 14 to 105d, the thread being formed into cloth by a conventional method.

An average fiber thickness which is above or below these ranges results in inappropriate intertwining of the silk fibers, and leads to problems in dyeing properties, degree of exhaustion, blurring and fixation properties of the ink and, further, in feeding property of the cloth inside the apparatus.

Conventional pre-processes as mentioned above may be performed, as needed, on the cloth suitable for textile printing of this invention. It should be noted, in particular, that, in some cases, it is more desirable for the cloth to contain 0.01 to 20 wt % of a water-soluble metallic salt or a water-soluble high molecular weight polymer with respect to the weight of the cloth when in the dry condition, thereby controlling the moisture percentage of the cloth.

Examples of the water-soluble high molecular weight polymer include: starch substances, such as corn and wheat flour; cellulose-type substances, such as carboxymethyl cellulose, methyl cellulose and hydroxyethyl cellulose; polysaccharides, such as sodium alginate, gum arabic, locust bean gum, tragacanth gum, guar gum and tamarind seeds; protein substances, such as gelatin and casein; natural water-soluble high molecular weight polymers, such as tannin-type substances and lignin-type substances.

Examples of a synthetic high polymer include: polyvinyl alcohol compounds, polyethylene oxide compounds, acrylic-type water,soluble high molecular weight polymers, and maleic-anhydride-type water-soluble high molecular weight polymers. Of these, the polysaccharide-type high polymers and the cellulose-type high polymers are especially preferable.

Examples of the water-soluble metallic salt include compounds forming typical ionic crystals and having a pH ranging from 4 to 10, like halides of alkaline metals or alkaline earth metals. Typical examples of the alkaline-metal salt include: NaCl, $Na_2SO_4$, KCl and $H_3COONa$. Typical examples of the alkaline-earth-metal salt include: $CaCl_2$ and $MgCl_2$. Of these, salts of Na, K and Ca are especially preferable.

There is no particular limitation regarding the textile-printing ink used for the textile-printing cloth of this invention as long as the ink is capable of dyeing silk fibers. An ink-jet textile-printing ink composed of a dye and an aqueous liquid medium is preferably employed.

Examples of dyes preferably used in the present invention include: acid dyes, 2:1-type metal complex dyes, basic dyes, direct dyes, reactive dyes, mordant dyes, acid mordant dyes, sulfur dyes, vat dyes, solubilized vat dyes, vegetable dyes, animal dyes, etc. Of these, acid dyes, reactive dyes and direct dyes are especially preferable. These dyes can be used alone or in the form of a mixture, or as a mixture having different hues.

The amount of dye used generally ranges from 2 to 25 wt %, more preferably, from 3 to 20 wt % and, most preferably, from 3 to 15 wt % with respect to the total ink amount A dye amount that is less than 2 wt % results in insufficient coloring density, and more than 25 wt % results in insufficient ink ejection property.

In another preferable form of the invention, approximately 10 to 20,000 ppm of chlorine ions and/or sulfate ions are added, with respect to the amount of dyes contained in the ink, and approximately 0.1 to 30 ppm in total of at least one kind of substance selected from the group: silicon, iron, nickel and zinc, is added to the ink.

When such an ink is used on the cloth suitable for ink-jet textile printing of this invention, it is possible to obtain a clearly printed dyed article with a high degree of exhaustion, high density and with no blurring. Further, use of such an ink makes possible a textile printing with high ejection performance, which generates no clogging or the like in the head nozzle for a long period of time.

In addition to the above-mentioned metallic salts, it is desirable for the ink to contain a total amount of calcium and/or magnesium of 0.1 to 30 ppm, more preferably, 0.2 to 20 ppm and, most preferably, 0.3 to 10 ppm, thereby attaining further improvement particularly in the degree of exhaustion.

Water, which is a preferred component of the liquid medium composing the ink of the ink-jet textile printing of this invention, composes 30 to 90 wt %, more preferably, 40 to 90 wt % and, most preferably, 50 to 85 wt %, with respect to the total ink amount.

The above are the preferred components of the ink-jet textile-printing ink used in the method of this invention. However, it is also possible to adopt a generally used organic solvent as the liquid medium of the ink. Examples of such an organic solvent include: ketones or keto alcohols, such as acetone and diacetone alcohol; ethers, such as tetrahydrofuran and dioxane; addition polymers of oxyethylene or oxypropylene, such as diethylene glycol, triethylene glycol, tetraethylene glycol, dipropylene glycol, tripropylene glycol, polyethylene glycol and polypropylene glycol; alkylene glycols having two to six carbon atoms, such as ethylene glycol, propylene glycol, trimethylene glycol, butylene glycol and hexylene glycol; triols, such as 1,2,6-hexanetriol; thiodiglycol; glycerin; low alkylethers of polyhydric alcohols, such as ethyleneglycol monomethyl (or ethyl) ether, diethyleneglycol monomethyl (or ethyl) ether and triethyleneglycol monomethyl (or ethyl) ether; low dialkylethers of polyhydric alcohols, such as triethyleneglycol dimethyl (or ethyl) ether and tetraethyleneglycol dimethyl (or ethyl) ether; sulfonine, N-methyl-2-pyrrolidone, 1,3-dimethyl-2-imidazolidinone, etc.

The content of the above water-soluble organic solvents is generally 3 to 60 wt % and, more preferably, 5 to 50%, with respect to the total weight of the ink.

Liquid mediums as mentioned above may be used alone or in a mixture. The most desirable liquid-medium composition contains at least one type of polyhydric alcohol. A composition consisting of thioglycol alone or a mixture of diethyleneglycol and thiodiglycol is especially preferable.

Further, it is possible to add, as needed, various types of dispersing agents, surface active agents, viscosity controlling agents, surface tension controlling agents, fluorescent whitening agents, etc., to the ink used in the method of this invention, having principal components as mentioned above.

Examples of such additives include: viscosity controlling agents., such as polyvinyl alcohol and water-soluble resins; various surface active agents of cationic or nonionic type; surface tension controlling agents, such as diethanolamine and triethanolamine; pH regulators with buffer solution, anti-mildew agents, etc.

In the ink-jet textile-printing method of this invention, textile printing is performed on a textile-printing cloth according to this invention, using a textile-printing ink as described above. Any known ink-jet recording system may be employed. The most effective example of the ink-jet recording system is disclosed in Japanese Patent Laid-Open No. 54-59936, in which the volume of ink increases rapidly by the action of heat energy and, as a result of this change in state, the ink is ejected through the nozzles. By performing recording on the textile-printing cloth of this invention with such a system, stable printing is possible.

To achieve very effective printing, it is desirable that the ejected droplets be within the range of 20 to 200 pl ($10^{-12}$ l) and the ink application within the range of 4 to 40 nl/mm$^2$.

An example of an apparatus suitable for textile printing using the textile-printing cloth of this invention is one which imparts heat energy corresponding to recording signals to the ink in the recording-head chamber, causing ink droplets to be generated by heat energy.

Figure 2:
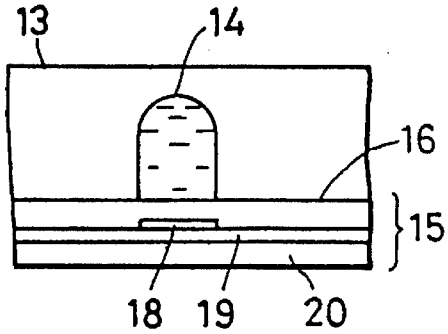
FIG. 2 is a cross-sectional view of the head portion of the ink-jet recording apparatus.
Figure 3:
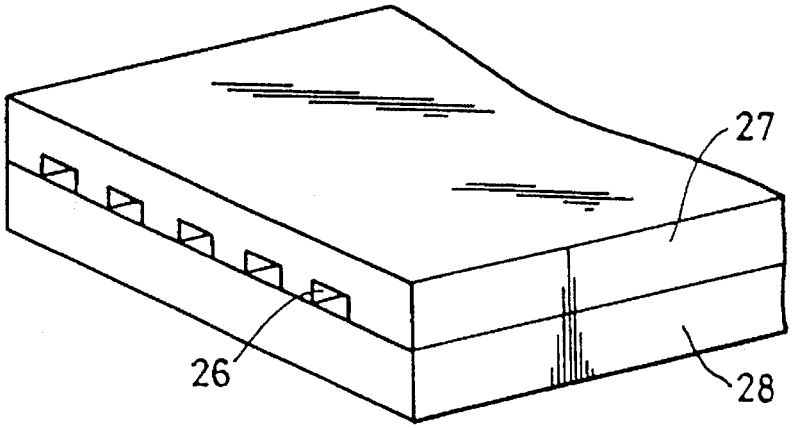
FIG. 3 is an outward perspective view of the head of FIG. 1 formed as a multi-head.

FIGS. 1, 2 and 3 show an example of the construction of the head which constitutes the principal section of the apparatus.

A head 13 is formed by gluing a plate made of glass, a ceramic material or plastic and having a groove 14 passing ink, to a heat generating head 15 used in thermal recording (though the drawings show a head, the present invention is not limited to such a head). The heat generating head 15 is composed of a protective layer 16 made of silicon oxide or the like, aluminum electrodes 17-1 and 17-2, a heat-generating-resistor layer 18 made of nichrome or the like, a heat storage layer 19, and a substrate 20 made of a material having satisfactory radiation properties, such as alumina. Ink 21 reaches an ejection orifice (a minute hole) 22, forming a meniscus 23 by a pressure P.

When an electrical signal is applied to the electrodes 17-1 and 17-2, the region of the heat generating head 15 which is indicated at n, generates heat rapidly, and a bubble is generated in the portion of the ink 21 which is in contact with the region n. The pressure of the bubble causes the meniscus 23 to protrude beyond the orifice 22, thereby ejecting the ink 21, which is turned into recording droplets 24 as it leaves the orifice 22, jumping toward the cloth 25 of this invention. FIG. 3 shows the outward appearance of a multi-head formed by arranging a number of heads together as shown in FIG. 1. This multi-head is produced by closely attaching a glass plate 27 having multi-grooves 26 to a heat generating head 28 similar to the one described with reference to FIG. 1. FIG. 1 is a sectional view of the head 13 taken along the ink flow passage, and FIG. 2 is a sectional view taken along the line A–B of FIG. 1.

Figure 4:
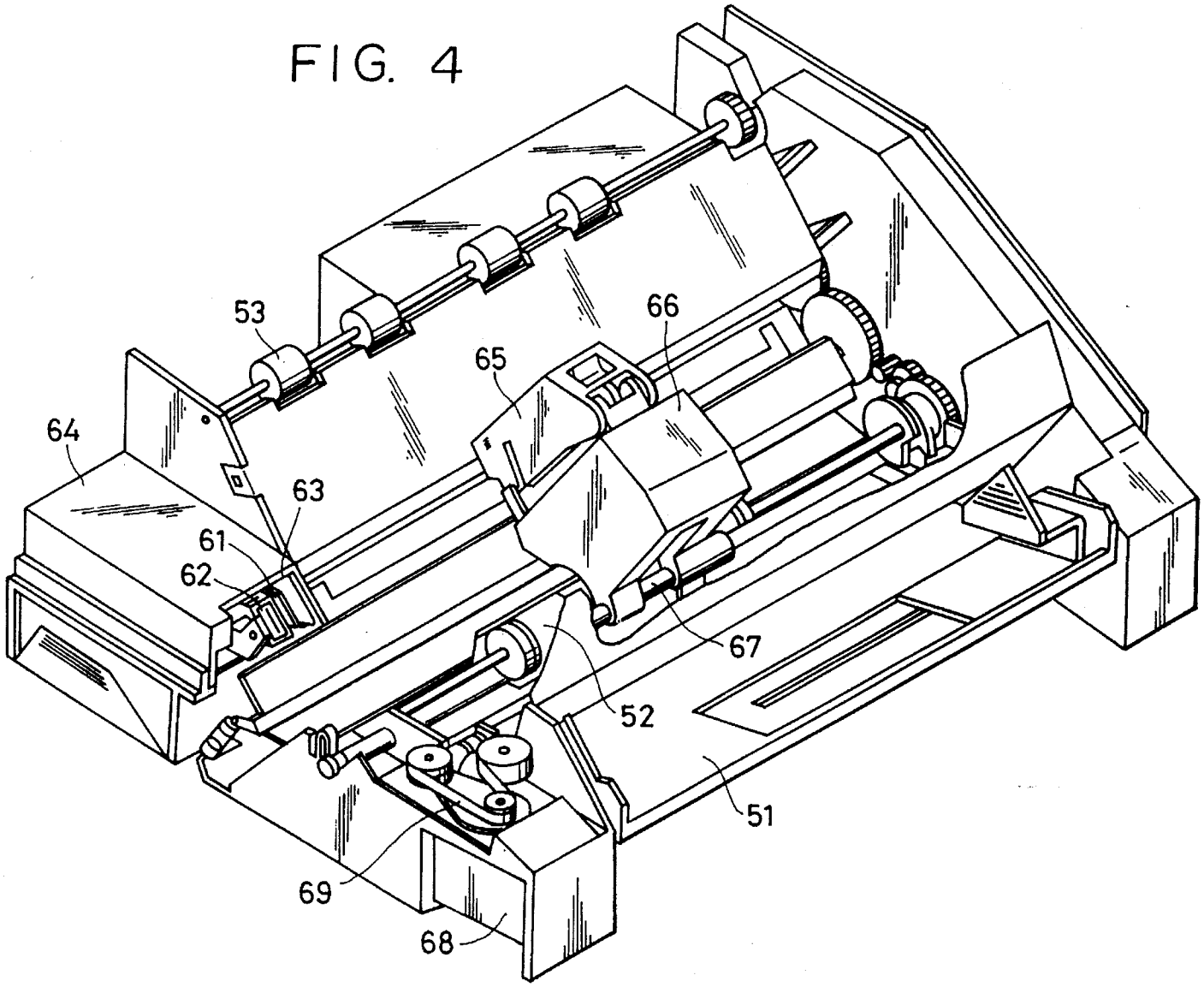
FIG. 4 is a perspective view showing an example of an ink-jet recording apparatus.

FIG. 4 shows an example of an ink-jet recording apparatus with such a head incorporated therein. Numeral 61 indicates a blade serving as a wiping member, one end of which is held by a blade holding member forming a fixed end, thus exhibiting a cantilever-like structure. The blade 61 is arranged adjacent to the area where recording is performed by the recording head. In this example, the blade 61 is held in a position in which it protrudes into the path of movement of the recording head. Numeral 62 indicates a cap, which is arranged at a home position adjacent to the blade 61 and which is adapted to move in a direction perpendicular to the direction of movement of the recording head, abutting the ejection surface of the head, thereby effecting capping. Numeral 63 indicates an absorbing member provided adjacent to the blade 61 and held, like the blade 61, in a position in which it protrudes into the path of movement of the recording head. The blade 61, the cap 62 and the absorbing member 63 constitute an ejection-performance recovery section 64, which removes water, dust, etc. from the ink-ejection surface by the blade 61 and the absorbing member Numeral 65 indicates a recording head which has an energy generating means and which ejects ink onto a cloth containing silk fibers and opposed to the ejection surface of the head having ejection outlets, thereby effecting recording. Numeral 66 indicates a carriage for moving the recording head 65, which is mounted thereon. The carriage 66 is slidably engaged with a guide shaft 67, and a part of the carriage 66 is connected with a belt 69 (the connection is not shown) driven by a motor 68. Due to this arrangement, the carriage 66 can move along the guide shaft 67, making it possible for the recording head 65 to move across the area where recording is performed and the area adjacent thereto.

Numeral 51 indicates a cloth feeding section for inserting the cloth of this invention, which is mainly composed of silk fibers. Numeral 52 indicates a feeding roller driven by a motor (not shown). Due to this construction, the cloth of this invention is fed to a position where it faces the ejection-outlet surface of the recording head. As the recording proceeds, the cloth is transferred to a cloth discharge section where cloth-discharge rollers 53 are arranged.

In the above construction, when the recording head 65 returns to the home position after the completion of recording, etc., the cap 62 of the ejection-performance recovery section 64 is withdrawn from the path of movement of the recording head 65, whereas the blade 61 continues to protrude into the path of movement. As a result, the ejection-outlet surface of the recording head 65 is wiped. When the cap 62 is brought into abutment with the ejection-outlet surface of the recording head 65 so as to effect capping, the cap 62 is moved in such a way as to protrude into the path of movement of the recording head.

When the recording head 65 moves from the home position to the recording start position, the cap 62 and the blade 61 are at the same positions as those where the above-described wiping is performed. As a result, the ejection-outlet surface of the recording head 65 is also wiped in the course of this movement.

The above movement of the recording head to the home position is performed not only upon completion of recording or at the time of ejection-performance recovery, but also during the movement of the recording head across the recording area for the purpose of recording. That is, during recording movement, the recording head moves at fixed intervals to the home position adjacent to the recording area, effecting the above-mentioned wiping.

The textile-printing ink, which has been imparted by the method of this invention to the textile-printing cloth of this invention, only sticks to the cloth, but is not fixed thereto. Thus, it is desirable that a process for fixing the ink to the cloth by reactive fixation and a process of removing unfixed dye should follow. The two processes may be effected by conventionally known methods, such as steaming, HT steaming or thermofixing, in which washing is conducted after processing.

EXAMPLES

Next, this invention will be described in more detail with reference to examples thereof and comparative examples. In the following, "parts" and "%" mean "parts by weight" and "weight %", respectively, unless otherwise noted

| Production of Ink (A) | |
|---|---|
| acid dye (C.I. Acid Yellow 110) | 7 parts |
| thiodiglycol | 24 parts |
| diethylene glycol | 11 parts |
| potassium chloride | 0.004 parts |
| sodium sulfate | 0.002 parts |
| sodium metasilicate | 0.001 parts |
| iron chloride | 0.0005 parts |
| water | 58 parts |

The above components were mixed with each other, and the solution was adjusted to a pH of 8.4 with sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (A).

| Production of Ink (B) | |
|---|---|
| acid dye (C.I. Acid Red 266) | 7 parts |
| thiodiglycol | 15 parts |
| diethylene glycol | 10 parts |
| tetraethylene glycol dimethylether | 5 parts |
| potassium chloride | 0.04 parts |
| sodium sulfate | 0.01 parts |
| sodium metasilicate | 0.001 parts |
| iron chloride | 0.0005 parts |
| nickel chloride | 0.0002 parts |
| water | 63 parts |

The above components were mixed with each other, and the solution was adjusted to a pH of 7.9 with sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (B).

| Production of Ink (C) | |
|---|---|
| acid dye (C.I. Acid Blue 185) | 9 parts |
| thiodiglycol | 23 parts |
| triethylene glycol monomethylether | 6 parts |
| potassium chloride | 0.05 parts |
| sodium metasilicate | 0.001 parts |
| iron chloride | 0.0005 parts |
| zinc chloride | 0.0003 parts |
| water | 62 parts |

The above components were mixed with each other, and the solution was adjusted to a pH of 8.3 with sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (C).

| Production of Ink (D) | |
|---|---|
| acid dye (C.I. Acid Brown 13) | 2 parts |
| acid dye (C.I. Acid Orange 67) | 1.5 parts |
| acid dye (C.I. Acid Blue 92) | 6.5 parts |
| thiodiglycol | 23 parts |
| diethylene glycol | 5 parts |

-continued

| Production of Ink (D) | |
|---|---|
| isopropyl alcohol | 3 parts |
| potassium sulfate | 0.01 parts |
| sodium metasilicate | 0.001 parts |
| iron sulfate | 0.0005 parts |
| nickel sulfate | 0.0003 parts |
| zinc sulfate | 0.0003 parts |
| water | 59 parts |

The above components were mixed with each other, and the solution was adjusted to a pH of 8.2 with sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (D).

| Production of Ink (E) | |
|---|---|
| acid dye (C.I. Acid Blue 129) | 12 parts |
| thiodiglycol | 16 parts |
| diethylene glycol | 17 parts |
| sodium chloride | 0.08 parts |
| potassium sulfate | 0.01 parts |
| sodium metasilicate | 0.0005 parts |
| iron sulfate | 0.001 parts |
| nickel chloride | 0.0003 parts |
| zinc sulfate | 0.0003 parts |
| water | 54.9 parts |

The above components were mixed with each other, and the solution was adjusted to a pH of 7.7 with sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (E).

| Production of Ink (F) | |
|---|---|
| acid dye (C.I. Acid Blue 129) | 12 parts |
| thiodiglycol | 16 parts |
| diethylene glycol | 17 parts |
| sodium chloride | 0.08 parts |
| potassium sulfate | 0.01 parts |
| sodium metasilicate | 0.0005 parts |
| iron sulfate | 0.001 parts |
| nickel chloride | 0.0003 parts |
| zinc sulfate | 0.0003 parts |
| calcium chloride | 0.006 parts |
| water | 54.9 parts |

The above components were mixed with each other, and the solution was adjusted to a pH of 7.7 with sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (F).

| Production of Ink (G) | |
|---|---|
| acid dye (C.I. Acid Blue 129) | 12 parts |
| thiodiglycol | 16 parts |
| diethylene glycol | 17 parts |
| sodium chloride | 0.08 parts |
| potassium sulfate | 0.01 parts |
| sodium metasilicate | 0.0005 parts |

-continued

| Production of Ink (G) | |
|---|---|
| iron sulfate | 0.001 parts |
| nickel chloride | 0.0003 parts |
| zinc sulfate | 0.0003 parts |
| magnesium chloride | 0.01 parts |
| water | 54.9 parts |

The above components were mixed with each other, and the solution was adjusted to a pH of 7.7 with sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (G).

| Production of Ink (H) | |
|---|---|
| direct dye (C.I. Direct Yellow 86) | 7 parts |
| thiodiglycol | 23 parts |
| diethylene glycol | 12 parts |
| potassium chloride | 0.004 parts |
| sodium sulfate | 0.002 parts |
| sodium metasilicate | 0.001 parts |
| iron chloride | 0.0005 parts |
| water | 58 parts |

The above components were mixed with each other, and the solution was adjusted to a pH of 8.4 with sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (H).

Example 1

A woven fabric of 100% silk, consisting of silk threads having an average thickness of 42d and composed of silk fibers having an average thickness of 3d, was immersed in a water vessel, and its moisture percentage was adjusted to 20% by adjusting the squeezing ratio. The squeezing ratio is a value obtained by the formula: a/b×100 (where "a" is an increase in the weight of a cloth when it has been immersed in a processing liquid and then squeezed by a mangle or the like; and "b" is the weight of the cloth prior to the processing).

Printing was performed on this woven fabric by a Color Bubble Jet Copier PIXEL PRO (trade name, manufactured by Canon Inc.) provided with inks (A) through (H) obtained as described above, thereby obtaining a solid sample of 2×10 cm under ink application conditions of 16 nl/mm$^2$. Fixation was effected by steaming for thirty minutes at 100° C. After that, the sample was washed in neutral detergent, and was then evaluated for clarity and blurring retardation. The evaluation results are given in Table 1.

Example 2

A woven fabric composed of 85% silk, consisting of silk threads having an average thickness of 21d and composed of silk fibers having an average thickness of 3.1d, and 15% of nylon, was immersed in a water vessel, and its moisture percentage was adjusted to 25% by adjusting the squeezing ratio.

Printing was performed on this woven fabric in the same manner as in Example 1, and the dyed article was evaluated for clarity and blurring retardation. The evaluation results are given in Table 1.

Example 3

A woven fabric of 100% silk, consisting of silk threads having an average thickness of 63d and composed of silk fibers having an average thickness of 3.2d, was immersed in a water vessel, and its moisture percentage was adjusted to 30% by adjusting the squeezing ratio.

Printing was performed on this woven fabric in the same manner as in Example 1, and the dyed article was evaluated for clarity and blurring retardation. The evaluation results are given in Table 1.

Example 4

A woven fabric like that of Example 1, of 100% silk, was immersed beforehand in an aqueous solution of sodium alginate having a concentration of 5% and was then immersed in a water vessel. Its moisture percentage was adjusted to 20% by adjusting the squeezing ratio.

Printing was performed on this woven fabric in the same manner as in Example 1, and the dyed article was evaluated for clarity and blurring retardation. The evaluation results are given in Table 1.

Example 5

A woven fabric of 100% silk, consisting of silk threads having an average thickness of 21d and composed of silk fibers having an average thickness of 2.7d, was immersed in a water vessel, and its moisture percentage was adjusted to 60% by adjusting the squeezing ratio. Printing was performed on this woven fabric in the same manner as in Example 1, and the dyed article was evaluated for clarity and blurring retardation. The evaluation results are given in Table 1.

Example 6

A woven fabric of 85% silk, consisting of silk threads having an average thickness of 28d and composed of silk fibers having an average thickness of 2.8d, and 15% of nylon, was immersed in a water vessel, and its moisture percentage was adjusted to 50% by adjusting the squeezing ratio. Printing was performed on this woven fabric in the same manner as in Example 1, and the dyed article was evaluated for clarity and blurring retardation. The evaluation results are given in Table 1.

Example 7

A woven fabric of 100% silk, consisting of silk threads having an average thickness of 42d and composed of silk fibers having an average thickness of 3.0d, was immersed in a water vessel, and its moisture percentage was adjusted to 40% by adjusting the squeezing ratio. Printing was performed on this woven fabric in the same manner as in Example 1, and the dyed article was evaluated for clarity and blurring retardation. The evaluation results are given in Table 1.

Example 8

A woven fabric of 100% silk, consisting of silk threads having an average thickness of 84d and composed of silk fibers having an average thickness of 3.2d, was immersed in a water vessel, and its moisture percentage was adjusted to 70% by adjusting the squeezing ratio. Printing was performed on this woven fabric in the same manner as in Example 1, and the dyed article was evaluated for clarity and blurring retardation. The evaluation results are given in Table 1.

Example 9

A woven fabric like that of Example 5, of 100% silk, was immersed beforehand in an aqueous solution of sodium alginate having a concentration of 5%, and its moisture percentage was adjusted to 20%.

Printing was performed on this woven fabric in the same manner as in Example 1, and the dyed article was evaluated for clarity and blurring retardation. The evaluation results are given in Table 1.

Comparative Example 1

A woven fabric of 100% silk like that used in Example 1 was immersed in a water vessel, and its squeezing ratio was adjusted to 20% by adjusting the squeezing ratio. After that, the cloth was dried to adjust its moisture percentage to 8%. Printing was performed on this woven fabric in the same manner as in the above examples, using the same ink-jet textile-printing inks (A) to (H) as used in the above examples, and the dyed article was evaluated for clarity and blurring retardation. The evaluation results are given in Table 1. The densities of the printed articles were lower than those of Example 1, resulting in a poorer degree of exhaustion.

Comparative Example 2

A woven fabric of 100% silk like that of Example 1 was immersed in a water vessel, and its moisture percentage was adjusted to 115% by adjusting the squeezing ratio. Printing was performed on this woven fabric in the same manner as in the above examples, using the same ink-jet textile-printing inks (A) to (H) as used in the above examples, and the dyed article was evaluated for clarity and blurring retardation. The evaluation results are given in Table 1. Regarding conveyance properties, problems were found in terms of feeding precision.

Comparative Example 3

A woven fabric of 100% silk, consisting of silk threads having an average thickness of 12d and composed of silk fibers having an average thickness of 2.3d, was immersed in a water vessel. Printing was performed on this woven fabric in the same manner as in the above examples, using the same ink-jet textile-printing inks (A) to (H) as used in the above examples, and the dyed article was evaluated for clarity and blurring retardation. The evaluation results are given in Table 1. The densities of the printed articles were lower than those of the above examples, resulting in poorer degree of exhaustion.

Comparative Example 4

A woven fabric of 100% silk, consisting of silk threads which had an average thickness of 150d and which were composed of silk fibers having an average thickness of 3.6d, was immersed in a water vessel, and its moisture percentage was adjusted to 50% by adjusting the squeezing ratio. Printing was performed on this woven fabric in the same manner as in the above examples, using the same ink-jet textile-printing inks (A) to (H) as used in the above examples, and the dyed article was evaluated for clarity and blurring retardation. The evaluation results are given in Table 1. The densities of the printed articles were lower than those of the above examples, resulting in a poorer degree of exhaustion. Also, regarding conveyance properties, problems were found in terms of feeding precision.

TABLE 1

| Evaluation Item | Examples 1 | 2 | 3 | 4 | 5 | 6 | 7 | 8 | 9 |
|---|---|---|---|---|---|---|---|---|---|
| Clarity*1 | ○ | ○ | ○ | ○ | ○ | ○ | ○ | ○ | ○ |
| Blurring retardation*2 | ○ | ○ | ○ | ○ | ○ | ○ | ○ | ○ | ○ |

| Evaluation Item | Comparative Examples 1 | 2 | 3 | 4 |
|---|---|---|---|---|
| Clarity*1 | X | Δ | X | X |
| Blurring retardation*2 | Δ | X | X | X |

In the case of blended-yarn fabrics, only the silk portions thereof were replaced by the above standard silk. Then, the above measurement was performed on the fabrics to obtain an average reflectance value, which was regarded as a unit.

○: 0.9 or less Δ: 0.9 to 0.95 ×: 0.95 or more

○: no irregularities Δ: some irregularities ×: lots of irregularities

As described above, it is possible to obtain an article dyed clearly with no ink blurring and with high density with the cloth suitable for textile printing of this invention.

The ink-jet textile-printing method of this invention excels in ink fixation and cloth feeding properties, making it possible to efficiently provide excellent dyed articles.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cloth for ink-jet textile printing that comprises silk threads made up mainly of silk fibers, said silk threads and silk fibers respectively having a thickness of 14 to 147 denier and 2.5 to 3.5 denier, and said cloth having a moisture percentage of 17 to 112% by weight.

2. A cloth for ink-jet textile printing according to claim 1, wherein said cloth contains a water-soluble metallic salt or a water-soluble high molecular weight polymer in an amount of 0.01 to 20 wt % with respect to the weight of said cloth when in a dry condition.

3. A cloth for ink-jet textile printing according to claim 1, wherein said cloth comprises silk fibers and cellulosic fibers in a blending ratio of at least 70% of silk fibers.

4. A cloth for ink-jet textile printing according to claim 1, wherein said cloth has a moisture percentage of 18 to 92% by weight.

5. A cloth for ink-jet textile printing according to claim 1, wherein said silk fibers have a thickness of 2.7 to 3.3 denier, and said silk threads have a thickness of 14 to 126 denier.

6. A printed article printed by an ink-jet textile printing method comprising the steps of:

imparting a textile printing ink to a cloth, wherein said cloth is a cloth for textile printing that comprises silk threads made up mainly of silk fibers, said silk threads and silk fibers respectively having a thickness of 14 to 147 denier and 2.5 to 3.5 denier, said cloth having a moisture percentage of 17 to 112% by weight, and conducting a dyeing process, and then a washing process to said cloth.

7. A printed article according to claim 6, wherein said cloth comprises silk fibers and cellulosic fibers in a blending ratio of at least 70% of silk fibers.

8. A printed article according to claim 6, wherein said silk fibers have a thickness of 2.7 to 3.3 denier, and said silk threads have a thickness of 14 to 126 denier.

9. A printed article according to claim 6, wherein said cloth has a moisture percentage of 18 to 92% by weight.

* * * * *

UNITED STATES PATENT AND TRADEMARK OFFICE

CERTIFICATE OF CORRECTION

PATENT NO. : 5,468,553 Page 1 of 2

DATED : November 21, 1995

INVENTOR(S) : SHOJI KOIKE, et al.

It is certified that error appears in the above-indentified patent and that said Letters Patent is hereby corrected as shown below:

COLUMN 4

Line 46, "water,soluble" should read --water-soluble--.

COLUMN 5

Line 7, "amount" should read --amount.--.

COLUMN 6

Line 4, "agents.," should read --agents,--.

COLUMN 13

Line 16, "Blurring retardation*2 Δ X X X " should read --Blurring retardation*2 Δ X X X .
*1 A cloth was chosen as a standard which was forme of silk threads having an average thickness of 42d and composed of silk fibers having an average thickness of 3d (with a moisture percentage of 12% in the normal state), and recording was performed o this cloth in the same manner as in the above examples without effecting moisture control. The maximum-absorption-wavelength reflectances of the records obtained were measured, and the average reflectance value thereof was regarded as a unit. Similarly, the maximum-absorption-wavelength reflectances of the records obtained in the above examples were measured, and the average value thereof was obtained for comparison.--.

UNITED STATES PATENT AND TRADEMARK OFFICE

CERTIFICATE OF CORRECTION

PATENT NO. : 5,468,553 Page 2 of 2

DATED : November 21, 1995

INVENTOR(S) : SHOJI KOIKE, et al.

It is certified that error appears in the above-indentified patent and that said Letters Patent is hereby corrected as shown below:

COLUMN 13

Line 22, "or more" should read --or more
*2 Inspection was conducted with the naked eye for any irregularities in the straight-line edges of the records, and a judgment was made as follows:--.

Signed and Sealed this

Twenty-third Day of April, 1996

*Attest:*

*Attesting Officer*

BRUCE LEHMAN

*Commissioner of Patents and Trademarks*